United States Patent [19]

Crapser

[11] Patent Number: 4,620,646

[45] Date of Patent: Nov. 4, 1986

[54] PUMP BUTTON AND OVERCAP ASSEMBLY, AND METHOD OF ASSEMBLY OF THE OVERCAP AND PUMP BUTTON ON A PUMP DISPENSER CONTAINER

[75] Inventor: James R. Crapser, Racine County, Wis.

[73] Assignee: S. C. Johnson & Son, Inc., Racine, Wis.

[21] Appl. No.: 749,852

[22] Filed: Jun. 28, 1985

[51] Int. Cl.[4] ..... B67D 5/32

[52] U.S. Cl. ..... 222/153; 222/402.11; 222/402.13; 222/182

[58] Field of Search ..... 222/402.1, 402.11, 402.13, 222/402.17, 153, 182

[56] References Cited

U.S. PATENT DOCUMENTS

| | | | |
|---|---|---|---|
| 3,198,400 | 8/1965 | Roehrich | 222/182 |
| 3,216,625 | 11/1965 | Corsette | 222/182 |
| 3,589,570 | 6/1971 | Gach | 222/402.13 |
| 3,779,427 | 12/1973 | Ewald | 222/153 |
| 3,797,705 | 3/1974 | Cooprider | 222/153 |
| 3,827,605 | 8/1974 | Knickerbocker | 222/153 |
| 4,065,036 | 12/1977 | Kirk, Jr. | 222/153 |
| 4,162,746 | 7/1979 | Anderson et al. | 222/153 |
| 4,418,842 | 12/1983 | Di Loreto | 222/153 |

*Primary Examiner*—Joseph H. Rolla
*Assistant Examiner*—Jay I. Alexander

[57] ABSTRACT

This invention relates to a pump dispensing type container and more particularly to the manner in which the customary pump button and overcap are assembled with respect to the container and pump assembly. Orientation of the pump button with respect to the overcap has been a problem. According to this invention the pump button is so related to the overcap so that the pump button need not be initially oriented with respect to the overcap, but after the pump button and overcap have been assembled with the container and pump assembly, the overcap will be held in place in a non-dispensing position until such time as the ultimate user rotates the pump button into alignment with the overcap. At this time the pump button is in position for actuation and is held in place by its interlocking with the dispensing tube of the pump.

13 Claims, 15 Drawing Figures

PUMP BUTTON AND OVERCAP ASSEMBLY, AND METHOD OF ASSEMBLY OF THE OVERCAP AND PUMP BUTTON ON A PUMP DISPENSER CONTAINER

This invention relates in general to new and useful improvements in pump dispensers, and more particularly to the placement of the pump button in the overall container assembly.

The present invention provides a conventional type of overcap and pump button assembly having key members on the overcap which are received in guide channels or grooves formed in the pump button. However, the relationship between the pump button and the overcap is one wherein the pump button may be mounted on the pump without special orientation, after which the overcap may be placed on the container and forced over the pump button without the key members entering into the guide channels. In effect, the pump button is wedged within a guide sleeve of the overcap. On the other hand, the wedging is not such as to prevent rotation of the pump button relative to the overcap. Thus, when the ultimate consumer receives the container, before he or she can dispense any of the product, it is necessary to rotate the pump button within the overcap until the guide channels are aligned with and receive the keys.

After the pump button has been oriented within the overcap, it is free to move for the necessary pumping strokes and is retained in the assembly by its connection to the dispensing tube of the pump.

In the drawing, wherein throughout like numerals refer to like parts,

Figure 1:
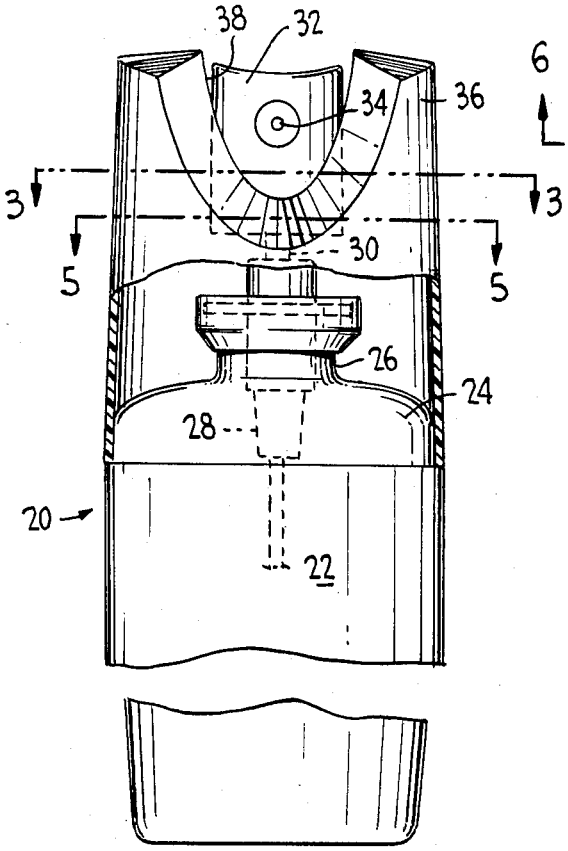
FIG. 1 is a side elevational view of the dispensing container with the lower portion of the container brokenaway.

Referring now to the drawing in detail, reference is first made to FIG. 1 wherein there is illustrated the components of the dispenser container which is the subject of this invention, the dispenser container being generally identified by the numeral 20. The dispenser container 20 includes a container member 22 which has a reduced cross-section upper portion 24 which terminates in the neck 26. A pump assembly, generally identified by the numeral 28, is mounted on the neck 26 and includes a dispensing tube 30 which is also the actuator.

The pump assembly 28 is provided with a conventional type of pump button 32 having a dispensing nozzle portion 34. The dispensing container 20 also includes an overcap generally identified by the numeral 36. The overcap 36 has an upper opening 38 through which the pump button 32 normally projects for actuation.

Figure 11:
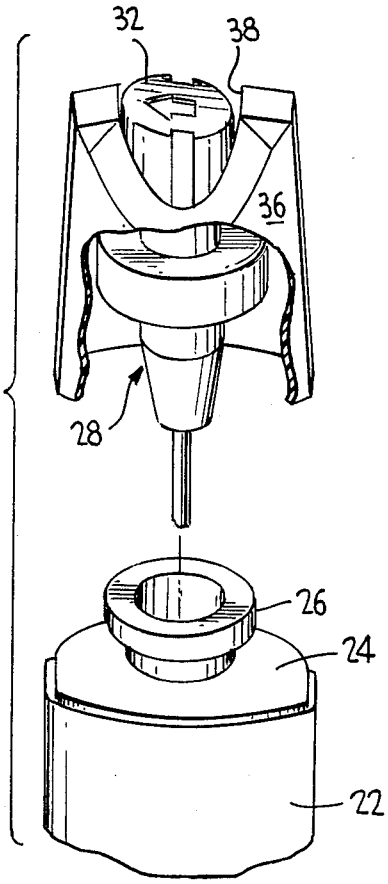
FIG. 11 is an exploded perspective view similar to FIG. 10 but with the pump button in place in the overcap but misaligned.

In accordance with this invention, it is proposed to assemble the pump button 32 and the overcap 36 with the container 22 and the pump assembly 28 without prior orientation of the pump button 32. Thus, as is shown in FIG. 11, the pump button 32 is placed on the dispensing tube 30 without regard to orientation.

After the pump button 32 has been placed on the pump assembly 28, the overcap 36 is positioned. The overcap 36 is forced into place over the pump button 32 in a manner to be described in more detail hereinafter. The overcap 36 is of a construction wherein it has an interlock with the reduced cross-section portion 24 of the container 22 so as to be retained in place.

Figure 12:
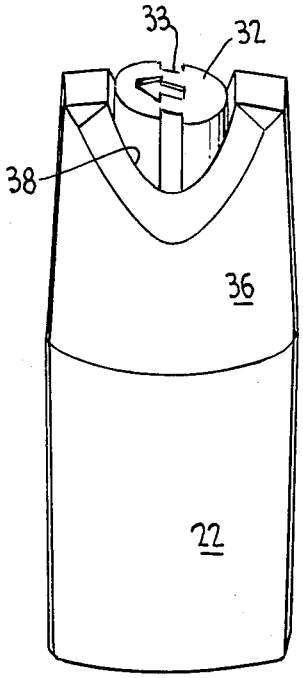
FIG. 12 is a perspective view of the container with the overcap in place but with the pump button misaligned.
Figure 13:
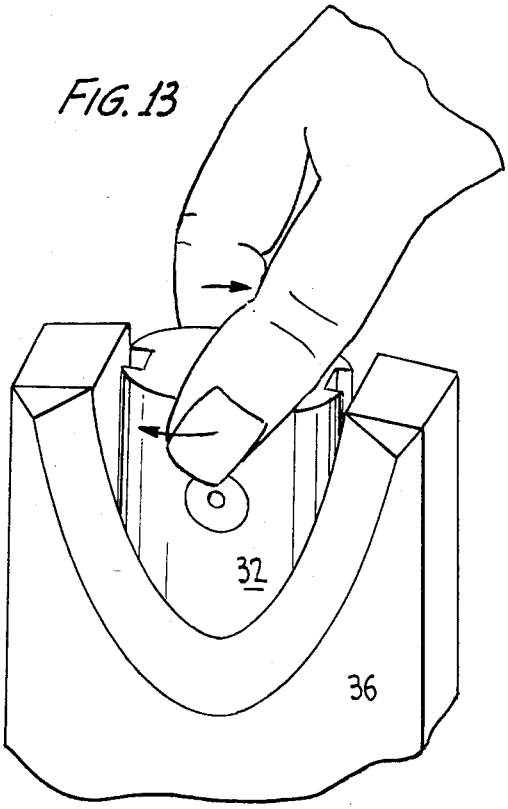
FIG. 13 is a perspective view showing one's fingers rotating the pump button into place.

In FIG. 12 the dispensing container 20 is illustrated in its shipping form to prevent inadvertent spraying of the contents thereof. However, it is not ready for use. During the assembly of overcap 36, the spray button 32 is forced to override key elements 52 (FIG. 7) located within guide sleeve 40. The lower edge of spray button 32 is then supported by the same elements 52, prohibiting the button from being depressed until the pump button 32 has been rotated so that guide channels 60 therein are aligned with and receive key members carried by the overcap, as will be described in detail hereinafter.

The upper portion of the assembled and ready-for-dispensing container assembly is illustrated in FIG. 1.

Figure 2:
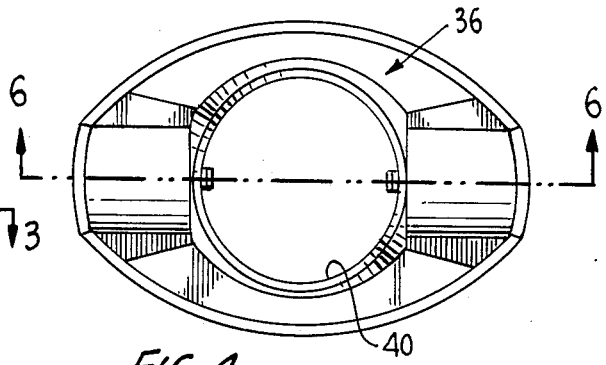
FIG. 2 is a top plan view of the overcap per se.
Figure 4:
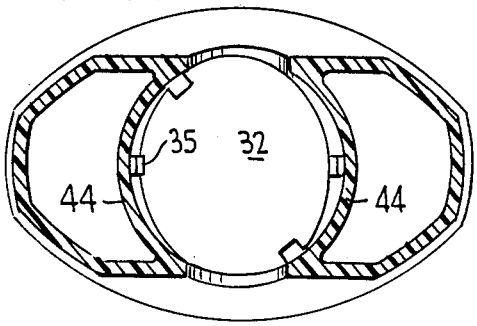
FIG. 4 is a horizontal sectional view similar to FIG. 3 and shows the pump button rotated to be in the misaligned position.
Figure 3:
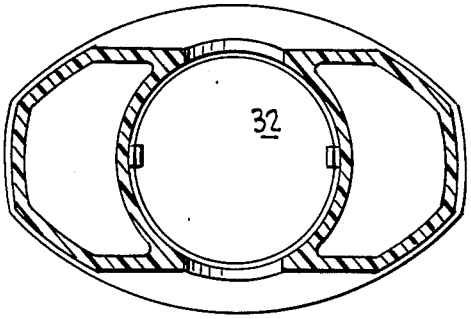
FIG. 3 is a transverse horizontal sectional view taken generally along the line 3—3 of FIG. 1 with the pump button in its aligned position as shown in FIG. 1.
Figure 5:
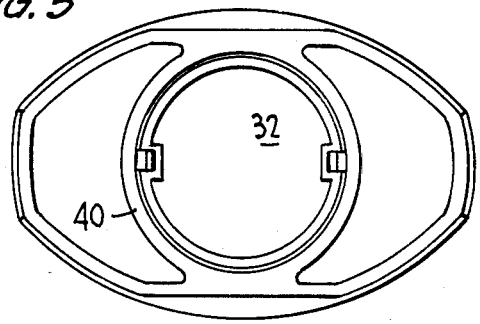
FIG. 5 is a horizontal sectional view taken generally along the line 5—5 of FIG. 1 but through the overcap per se.
Figure 6:
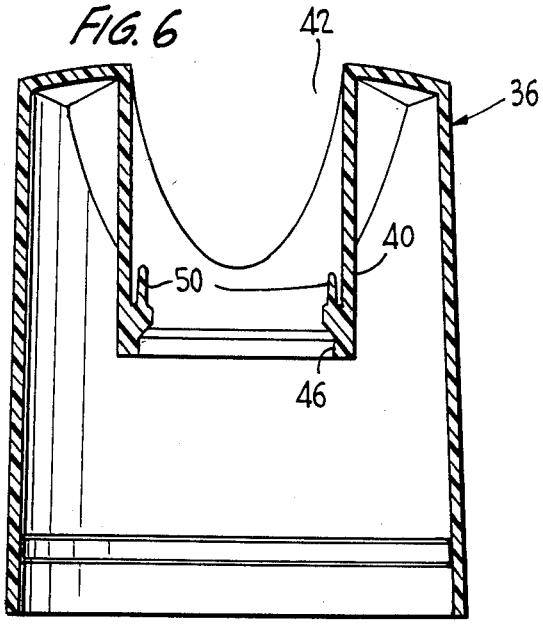
FIG. 6 is a vertical sectional view taken generally along the line 6—6 of FIG. 2 and shows the details of the overcap.

As is clearly shown in FIG. 2, the overcap 36 has a centrally located guide sleeve 40. The guide sleeve 40 is best shown in FIG. 6. The course of an opening 42 in the opposite sides of the overcap for receiving one's fingers to actuate the pump button 32 has an upper portion which is in the form of arcuate portions 44, as is best shown in FIGS. 3 and 4. However, the lower part of the guide sleeve 40 is in the form of a complete circle, as is best shown in FIG. 5.

The upper portion defined by the opposed portions 44 is of a relatively large diameter and is considerably larger than the internal diameter of a base portion 46 of the guide sleeve 40. Thus, as is clearly shown in FIG. 5, an upstanding shoulder 40 is presented by the base portion 46.

Figure 7:
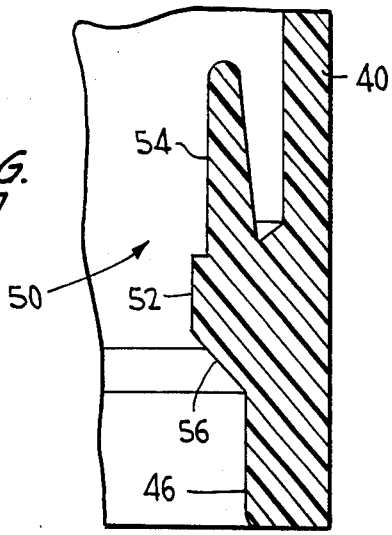
FIG. 7 is an enlarged fragmentary sectional view through the overcap showing the specifics of the key member.

Referring once again to FIG. 6, it will be seen that the guide sleeve 40 carries a pair of key members, generally identified by the number 50. Each of the key members 50, as is best shown in FIG. 7, includes a base portion 52 from which a key element 54 projects axially upwardly. It is to be noted that the key element 54 is radially inwardly spaced from the wall of the adjacent part of the guide sleeve 40 and is deflectable radially outwardly relative thereto. Key elements 52 are radially spaced slightly within the external diameter of the base portion of pump button 32.

It is also to be noted that the base portion 52 has a lower cam surface 56 for engagement by the pump button 32. At this time it is pointed out that the internal diameter of the base portion 46 is slightly greater than the external diameter of the body of the pump button which will be described in detail here.

Figure 14:
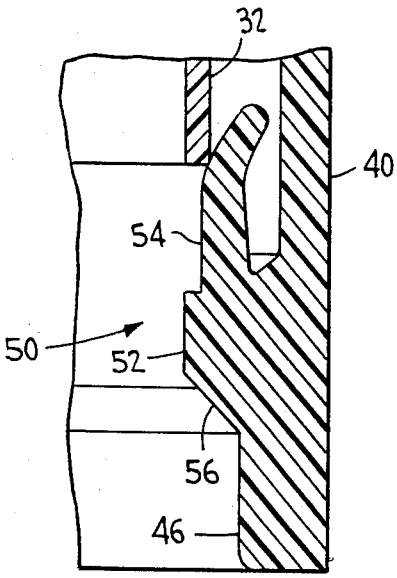
FIG. 14 is an enlarged fragmentary sectional view through the overcap similar to the view of FIG. 7 but showing the relationship of the cap and key when misaligned.
Figure 15:
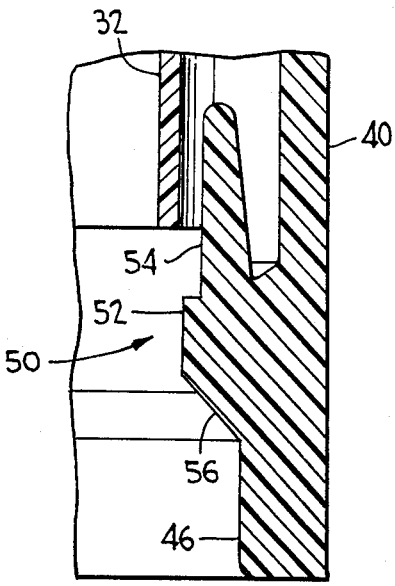
FIG. 15 is an enlarged fragmentary sectional view through the overcap similar to the view of FIG. 7 but showing the relationship of the cap and key when aligned.

FIG. 14 is a view similar to FIG. 7, but FIG. 14 shows the relationship of the cap and key when in the misaligned position. FIG. 15 again is similar to the view of FIG. 7, but shows the relationship of the cap and key in the aligned position.

Figure 8:
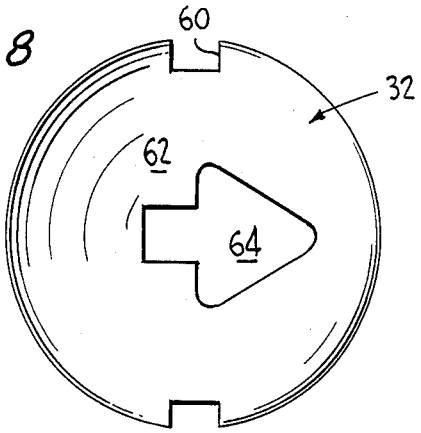
FIG. 8 is a plan view of the pump button.
Figure 9:
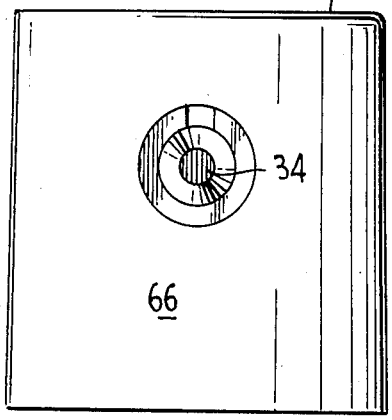
FIG. 9 is an elevational view of the pump button.
Figure 10:
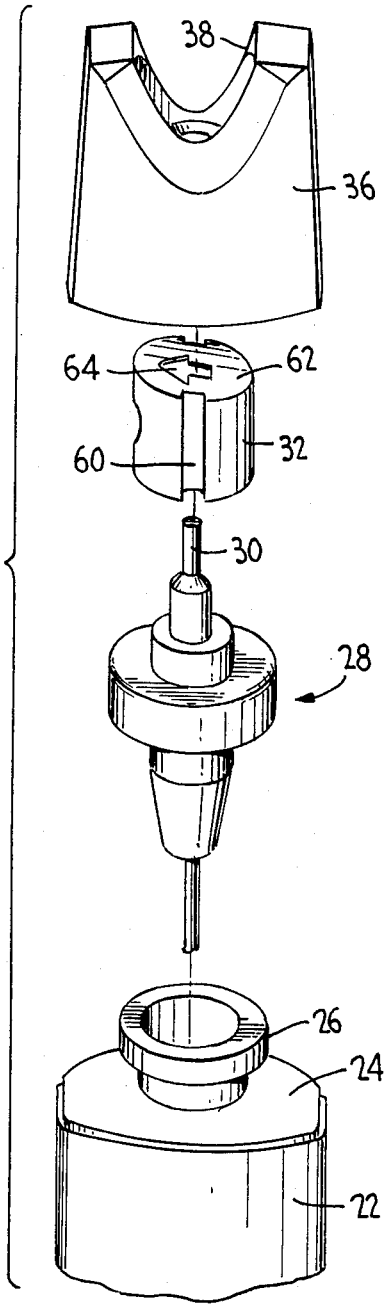
FIG. 10 is an exploded perspective view showing the overcap and pump button prior to assembly with the container and pump.

As is best shown in FIG. 8, the pump button 32 is circular in cross-section and is provided with a pair of diametrically opposite guide channels or grooves 60. The grooves 60 are intended to receive the key members 50.

The pump button 32 has a top wall 62 with an arrow 64 embossed thereon to indicate the direction of dispensing. In accordance with the arrow 64, the nozzle 34 is circumferentially located in a sidewall 66 of the pump button 32. It is to be noted that the sidewall is slightly tapered from the bottom to the top so as to facilitate insertion of the pump button 32 through the guide sleeve 40 from the bottom up.

At this time it is pointed out that both the pump button 32 and the overcap 36 are formed of a resilient plastic material. Thus, after the pump button has been placed on the pump assembly and the overcap is moved into place on the container, it will be seen that the top edge of the pump button 32 will engage the cam surfaces 56. The net result will be that the guide sleeve 40 will be deformed so as to take a generally oval cross-section as is generally shown in FIG. 4 when the guide channels 60 are not aligned with the key members 50. On the other hand, when the pump button 32 is rotated so as to have the key members 50 received in the guide channels 60, the guide sleeve 40 will assume its generally circular cross-section as is generally shown in FIG. 3.

It is to be understood that the relative diameters of the pump button 32, the interior of the guide sleeve 40, and the resiliency of the overcap 36 in particular as well as that of the pump button 32 will be such that the improperly oriented pump button 32 may be forced into the guide sleeve 40 with a resultant deflection due to the projecting of the key members 50. This is a primary key to the present invention. The radial pressure contact between the key elements 54 which extend from the key members 50 and the wall 66 of the pump button 32 is one wherein the pump button 32 may be rotated by one's fingers manually within the overcap so as to align the guide channels 60 with the key members 50, while at the same time being sufficient to prevent accidental loss of the pump button until the overall container is received by the ultimate user.

It is to be understood that a misaligned pump button 32 will be held down in a non-dispensing position by the overcap. Thus, the product cannot be dispensed until the pump button 32 is oriented relative to the overcap 36. Once this is accomplished, the pump button 32 is retained in place relative to the container by its engagement with the dispensing tube 30.

Although only a preferred embodiment of the relationship of the pump button and the overcap has been specifically illustrated and described herein, it is to be understood that minor variations may be made in this relationship without departing from the spirit and scope of the invention as defined by the appended claims.

It is claimed:

1. A method of assembling a pump button and an overcap with a container having a pump including a dispensing tube, said method comprising the steps of providing a dispensing pump button having at least one axial guide and an overcap having a bore for receiving the pump button, and at least one key member receivable in said guide channel and projecting into said bore, assembling said pump button on said dispensing tube, then telescoping said overcap onto said pump button and into position on said container with said key member radially resiliently engaging said pump button to retain said pump button on a pump assembly, said pump button being moved by said overcap to a depressed inoperative position.

2. A method of assembling according to claim 1 wherein the pump button is thereafter rotated to align said key member into said guide channel.

3. A method of assembling according to claim 1 wherein the thus-assembled container, pump, pump button and overcap rely upon a user for rotating the pump button to align the guide groove with the key member to release the pump button for use.

4. An overcap and pump button assembly comprising an overcap being equipped with a bore and a pump button, said overcap including an outer shell having an open end for receiving and forming an interlock with a shouldered container, and a guide sleeve within said outer shell, said pump button having a tubular body having formed therein at least one axial guide channel, said guide sleeve defining a base of a diameter of freely receive said pump button and including a radially inwardly projecting key member for reception in said guide channel; the relative diameters of said tubular body and said bore, the radial extent of said key member, and the resiliencies of said guide sleeve and said tubular body being such that when said key member and said guide channel are misaligned said pump button is forcibly engageable into said guide sleeve with said key member engaging said pump button body in radial compressed relation sufficient to retain said pump button in said guide sleeve in a depressed, inoperative position while permitting manual rotation of said pump button within said guide sleeve to align said guide channel with said key member.

5. An assembly according to claim 4 wherein said key member has a lower cam surface whereby said pump button is receivable into said guide sleeve only from the button of said guide sleeve.

6. An assembly according to claim 4 wherein said key member includes a base and an upper free standing portion radially inwardly spaced from and radially outwardly deformable towards said guide sleeve.

7. An assembly according to claim 4 wherein said key member includes a base and an upper free standing portion radially inwardly spaced from and radially outwardly deformable towards said guide sleeve and said base has a lower cam surface whereby said pump button is receivable into said guide sleeve only from the bottom of said guide sleeve.

8. An assembly according to claim 6 wherein said guide sleeve has a lower reduced internal diameter portion defining an axially outwardly directed shoulder.

9. An assembly according to claim 6 wherein said guide sleeve has a lower reduced internal diameter portion defining an axially outwardly directed shoulder, and said key members' upper free standing portion generally projects from said shoulder.

10. An assembly according to claim 8 wherein the diameter of said pump button body is less than that of said lower reduced internal diameter portion.

11. An assembly according to claim 10 wherein said pump button tapers in diameter axially upwardly.

12. An assembly according to claim 4 wherein said pump button tapers in diameter axially upwardly.

13. An assembly according to claim 4 wherein said pump button and said overcap are formed of resilient plastic material.

* * * * *

UNITED STATES PATENT AND TRADEMARK OFFICE

CERTIFICATE OF CORRECTION

PATENT NO. : 4,620,646

DATED : November 4, 1986

INVENTOR(S) : James R. Crapser

It is certified that error appears in the above-identified patent and that said Letters Patent is hereby corrected as shown below:

In Column 4, Line 39, the second to the last word, "of" should read, --to--.

Signed and Sealed this

Twenty-seventh Day of September, 1988

*Attest:*

DONALD J. QUIGG

*Attesting Officer*

*Commissioner of Patents and Trademarks*